US005515965A

United States Patent [19]

Boldrini et al.

[11] Patent Number: 5,515,965

[45] Date of Patent: May 14, 1996

[54] EASY OPENING CIGARETTE PACKET

[75] Inventors: Fulvio Boldrini, Ferrara; Carlo Trimani, Bologna, both of Italy

[73] Assignee: G. D S.p.A., Bologna, Italy

[21] Appl. No.: 438,211

[22] Filed: May 9, 1995

[30] Foreign Application Priority Data

May 10, 1994 [IT] Italy ..... BO94A0205

[51] Int. Cl.[6] ..... B65D 5/54

[52] U.S. Cl. ..... 206/264; 229/87.05; 229/87.13

[58] Field of Search ..... 206/264, 271, 206/273; 229/87.05, 87.13

[56] References Cited

U.S. PATENT DOCUMENTS 2,267,878 12/1941 Smrekar ..... 206/264

3,814,301 6/1974 Niepmann ..... 206/264 X 4,091,929 5/1978 Krane ..... 206/602

FOREIGN PATENT DOCUMENTS 551267 2/1943 United Kingdom .

*Primary Examiner*—Jacob K. Ackun

*Attorney, Agent, or Firm*—Cushman Darby & Cushman

[57] ABSTRACT

In a cigarette packet that consists of a single wrapper with an easy opening tear ribbon, applied to the inside surface, the wrapper exhibits break lines coinciding one with each longitudinal edge of the ribbon, and incisions positioned to coincide with the opposite ends of the ribbon; also applied to the inside surface of the wrapper, at least over the areas exhibiting the incisions, are respective ribbon patches able to restore the continuity of the wrapper where broken by the incisions, in such a way that the contents of the packet will remain isolated from the external environment until the ribbon is removed.

10 Claims, 1 Drawing Sheet

EASY OPENING CIGARETTE PACKET

BACKGROUND of the INVENTION

The present invention relates to a cigarette packet with an easy opening feature.

In particular, the present invention relates to an easy opening cigarette packet of the type provided with a tear ribbon, and more precisely to a packet fashioned from one layer of material only, that is to say, in which the cigarettes are enveloped by a single wrapper.

Cigarette packets are composed generally of three distinct wrappers: an inner foil wrapping, an outer wrapping of paper material, and an overwrapping of transparent and heat-sealable material.

For certain markets, however, manufacturers offer a packet designed as a single wrapper able to combine all the essential packaging functions, though in a more economical type of solution. In this instance, the wrapper consists in a single sheet of material that can be paper based or, preferably, a plastic. The properties of the plastic utilized, for example polypropylene, are such as to allow the fabrication of a suitably rigid packet capable of supporting the cigarettes to good effect; at the same time, the wrapper is waterproof and can be printed for presentational and advertising purposes.

The technique employed when wrapping cigarettes in a one-layer material is substantially the same as that utilized for the innermost foil wrapping of a composite type packet. Indeed the plastic wrapper is obtained by folding a single sheet of plastic material around a relative group of cigarettes.

In the case of conventional packets exhibiting the transparent overwrapping, it is the normal practice to apply a ribbon of minimal transverse dimensions to one face of the sheet from which the transparent overwrapping is fashioned, thus providing a guide line along which the packet opens with ease.

The finished packet emerges with the slender ribbon positioned on the inside face of the overwrapping, extending substantially around the edges of the top end face. In order that the consumer may seize the ribbon and tear open the overwrapping in the manner intended, the sheet is prepared with incisions made near to at least one of the two ends of the ribbon, in such a way as to provide at least one readily accessible tab on the finished packet, coinciding with the end of the ribbon, which can be taken hold of and pulled.

Likewise in the case of the one-layer wrapper, the prior art embraces the notion of applying a ribbon to facilitate the process of opening the packet. With the conventional type of packet, however, the incisions made in the overwrapping have no ultimate impact on airtightness, whereas in the case of the one-layer wrapper, a cut made in any part of the material must clearly jeopardize the hermetic seal afforded by the packet.

Various solutions have been proposed with a view to overcoming this problem, one of which is to avoid cutting entirely through the one-layer wrapper, but rather to make incisions that penetrate only a part of the overall thickness of the material. This type of solution has proved difficult to implement from a technical standpoint, since the blade utilized in making the incision tends to wear rapidly and lose its cutting edge: consequently, given the extremely limited thickness of the material, the blade will be rendered unable to make any impression whatever and subsequent laceration becomes impossible.

The object of the present invention is to provide a cigarette packet of the type comprising a one-layer wrapper, provided with an easy opening tear ribbon, such as will ensure a hermetic seal while affording ready access to at least one end of the ribbon. The aforementioned object is realized in an easy opening cigarette packet according to the present invention.

SUMMARY OF THE INVENTION

The cigarette packet disclosed consists in a single wrapper with an easy opening tear ribbon applied to the inside surface, enveloping a relative plurality of cigarettes and exhibiting an incision positioned to coincide with at least one end of the ribbon. To advantage, the packet comprises a ribbon patch, covering at least the area of the wrapper occupied by the incision and proportioned so as to encompass the incision completely, applied stably to and in airtight association with the inside surface of the wrapper in such a way as to restore the continuity of the wrapper where broken by the incision.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
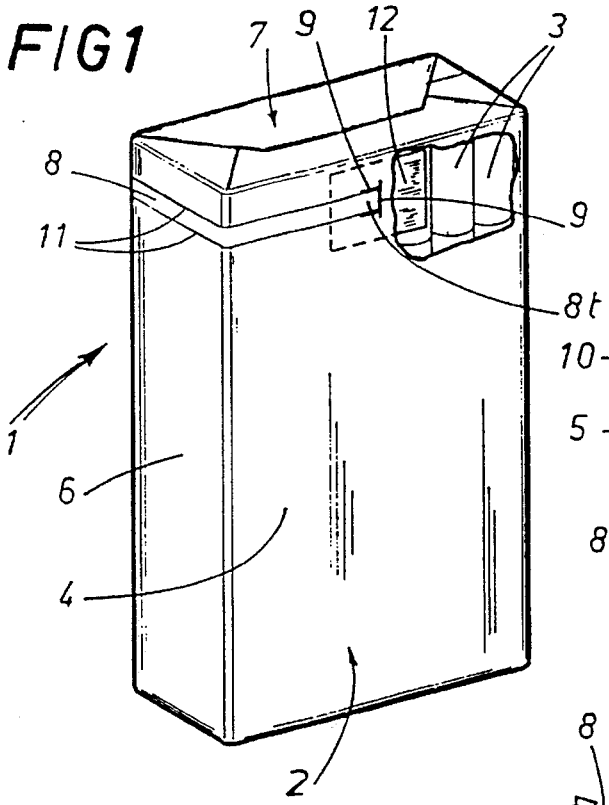
FIG. 1 illustrates a packet of cigarettes embodied in accordance with the present invention, seen in perspective and with certain parts omitted better to reveal others.

With reference to the drawings, a cigarette packet according to the present invention, denoted 1 in its entirety, consists essentially in a one-layer type wrapper 2 fashioned from a plastic material, polypropylene for example, and enveloping a group of cigarettes 3. The packet 1 is of substantially parallelepiped shape, exhibiting a front face 4 and a rear face 5 of identical proportions on mutually opposite sides, also two flank faces 6, and two end faces, top and bottom respectively, of which the top end face is denoted 7 in the drawings.

8 denotes a tear ribbon applied to the inwardly directed surface of the wrapper 2, positioned near to the top end face 7 and disposed in contact with the cigarettes 3, which serves to facilitate the process of breaking open the packet 1. The ribbon 8 occupies just half the total perimeter of the top end face 7 and, more exactly, extends transversely around the packet 1 between a median area of the front face 4 and a median area of the rear face 5, spanning the full width of one flank face 6.

To ensure that one end of the ribbon 8 can readily be gripped, and to enable the complete and accurate removal of the portion of the wrapper 2 associated with the ribbon 8, incisions 9 and 10 are made in the relative sheet of material to coincide with the two opposite ends of the ribbon 8. The incisions 9 and 10 are numbered independently in the drawings given that the one, denoted 9, borders the leading end **8*t* of the ribbon 8 on three sides, whereas the other 10 borders only the transverse side of the tail end 8*b*. It is for the sake of clarity that the end 8***t* of the ribbon seized and pulled to open the packet 1 is referred to as the leading end and thus distinguishable from the opposite or tail end 8*b*. The two incisions 9 and 10 are interconnected by break lines 11 formed on the wrapper 2 to coincide with the longitudinal edges of the ribbon 8. The break lines 11 are created preferably by weakening rather than piercing the material of the wrapper 2 so that, in this area at least, there will be no problems attributable to any loss of hermetic seal. Also applied to the inwardly directed surface of the wrapper 2, covering the areas occupied by the incisions 9 and 10 in the front and rear faces 4 and 5, are respective ribbon patches 12.

The ribbon patches 12 are wider than the ribbon 8, and will be secured to the wrapper 2 in such a way as to effect a seal, thus restoring the continuity of the wrapper 2 at the incisions 9 and 10.

Figure 2:
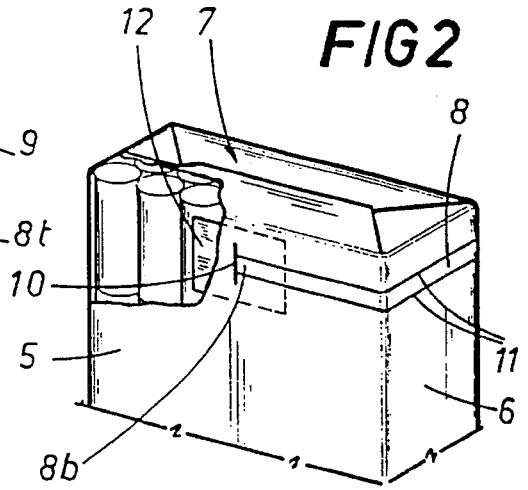
FIG. 2 illustrates the uppermost portion of the packet as in FIG. 1, viewed in perspective from a different direction.

Given that the wrapper 2 is embodied typically in a heat-sealable material, both the ribbon 8 and the ribbon patches 12 can be applied to the wrapper by heat-sealing, which will afford a perfect bond in terms both of providing mechanical strength and of ensuring an airtight surface. The ribbon patches 12 themselves might assume any of several different geometries: in the example of FIGS. 1, 2 and 5, for instance, the patch appears rectangular and covers an area of the wrapper 2 larger than that occupied directly by the corrresponding incision 9 or 10.

Figure 4:
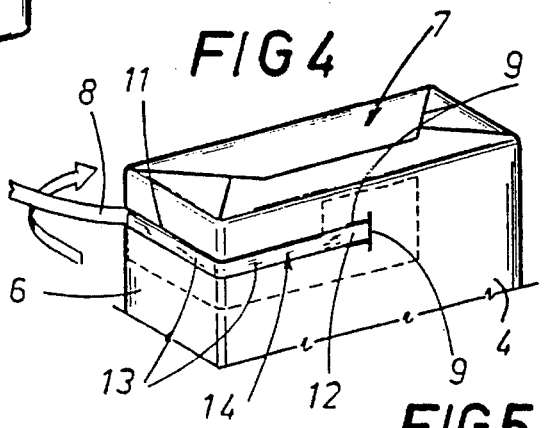
FIGS. 3 to 5 are further perspective views showing other possible embodiments of the packet according to the present invention.
Figure 3:
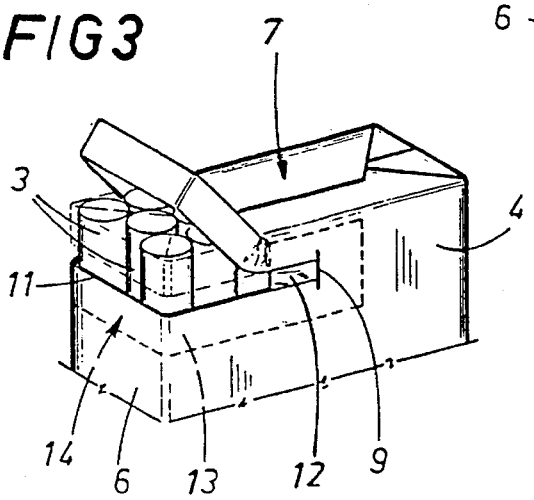

FIGS. 3 and 4 illustrate a particular arrangement in which two rectangular ribbon patches 12 covering the areas occupied by the incisions 9 and 10 are interconnected at bottom by a strip 13.

In FIG. 3, the top edge of the strip 13 coincides with the lower break line 11, so that the removal of the ribbon 8 creates an opening in the wrapper 2 through which the contents remain partly exposed even with the top end face 7 positioned flat. The strip 13 thus provides a reinforcement 14 serving to strengthen the edge of the wrapper defined by the lower break line 11.

In FIG. 4, by contrast, the top edge of the strip 13 coincides with the upper break line 11. Thus, when the ribbon 8 is removed together with the relative portion of the wrapper 2, the packet still remains substantially closed thanks to the presence of the strip 13. The top end face 7 can be bent back just the same, allowing easy access to the cigarettes 3. To advantage, the strip 13 functions not only as a reinforcement 14 for the edge coinciding with the lower break line 11, but also as a restraint, or frame, helping to protect the cigarettes 3.

Figure 5:
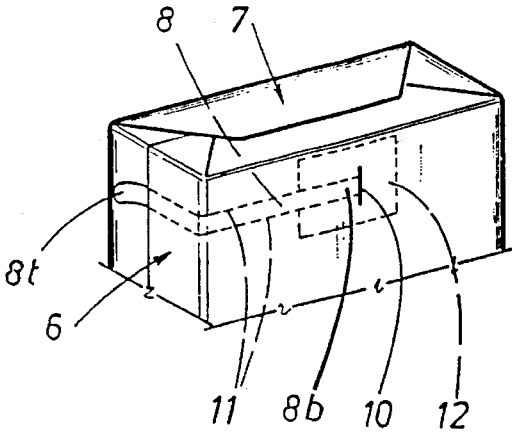

In the example of FIG. 5, the arrangement of the ribbon 8 differs from that of the other solutions indicated in that the leading end 8*t* projects from one of the two overlapping longitudinal edges (not numbered) of the wrapper 2, which extend along one of the flank faces 6. In this instance, one ribbon patch 12 only is applied, coinciding with the area occupied by the single incision 10, and access to the cigarettes will be gained by bending the top end face 7 obliquely.

What is claimed:

1. An easy opening cigarette packet, comprising:

a wrapper, enveloping a plurality of cigarettes, consisting in a single sheet of material furnished with a tear ribbon applied to the inside surface and exhibiting an incision positioned to coincide with at least one end of the ribbon;

a ribbon patch, covering at least the area of the wrapper exhibiting the incision and of dimensions such as to encompass the incision completely, which is applied stably to and in airtight association with the inside surface of the wrapper in such a way as to restore the continuity of the wrapper at the area occupied by the incision.

2. A cigarette packet as in claim 1, wherein the ribbon patch is fused to the inside surface of the wrapper.

3. A cigarette packet as in claim 1, consisting in a single wrapper exhibiting incisions positioned to coincide one with each end of the ribbon, and comprising a ribbon patch covering each incision, wherein the ribbon patches are integral with and interconnected by a strip serving to strengthen the lower edge of the opening created in the wrapper by the removal of the ribbon.

4. A cigarette packet as in claim 3, consisting in a single wrapper exhibiting break lines located to coincide one with each longitudinal edge of the ribbon, wherein the top edge of the strip coincides substantially with the lower break line exhibited by the wrapper.

5. A cigarette packet as in claim 3, consisting in a single wrapper exhibiting break lines located to coincide one with each longitudinal edge of the ribbon, wherein the top edge of the strip coincides substantially with the upper break line exhibited by the wrapper, and the strip completely overlaps the ribbon.

6. A cigarette packet as in claim 4, consisting in a single wrapper exhibiting break lines located to coincide one with each longitudinal edge of the ribbon, wherein the top edge of the strip coincides substantially with the upper break line exhibited by the wrapper, and the strip completely overlaps the ribbon.

7. A cigarette packet as in claim 2, consisting in a single wrapper exhibiting incisions positioned to coincide one with each end of the ribbon, and comprising a ribbon patch covering each incision, wherein the ribbon patches are integral with and interconnected by a strip serving to strengthen the lower edge of the opening created in the wrapper by the removal of the ribbon.

8. A cigarette packet as in claim 7, consisting in a single wrapper exhibiting break lines located to coincide one with each longitudinal edge of the ribbon, wherein the top edge of the strip coincides substantially with the lower break line exhibited by the wrapper.

9. A cigarette packet as in claim 7, consisting in a single wrapper exhibiting break lines located to coincide one with each longitudinal edge of the ribbon, wherein the top edge of the strip coincides substantially with the upper break line exhibited by the wrapper, and the strip completely overlaps the ribbon.

10. A cigarette packet as in claim 8, consisting in a single wrapper exhibiting break lines located to coincide one with each longitudinal edge of the ribbon, wherein the top edge of the strip coincides substantially with the upper break line exhibited by the wrapper, and the strip completely overlaps the ribbon.

* * * * *